United States Patent [19]

Morita

[11] Patent Number: 4,822,192

[45] Date of Patent: Apr. 18, 1989

[54] DOCUMENT FEED DEVICE WITH PIN TRACTOR ASSEMBLY

[75] Inventor: Toshiki Morita, Toyoake, Japan

[73] Assignee: Brother Kogyo Kabushiki Kaisha, Nagoya, Japan

[21] Appl. No.: 113,984

[22] Filed: Oct. 29, 1987

Related U.S. Application Data

[62] Division of Ser. No. 814,126, Dec. 27, 1985, Pat. No. 4,729,682.

[30] Foreign Application Priority Data

Dec. 28, 1984 [JP] Japan ..... 59-199595
Dec. 29, 1984 [JP] Japan ..... 59-199955
Dec. 29, 1984 [JP] Japan ..... 59-199956

[51] Int. Cl.[4] ..... B41J 11/78

[52] U.S. Cl. ..... 400/616.3; 400/645; 226/83

[58] Field of Search ..... 226/82, 83, 84, 85, 226/87, 79; 400/616, 616.1, 616.2, 616.3, 642, 645, 645.4, 695.5, 690.4

[56] References Cited

U.S. PATENT DOCUMENTS 1,490,536 4/1924 Neth ..... 400/616.3 X
2,355,668 8/1944 Morse ..... 400/616.3 X
2,432,967 12/1947 Johnson ..... 400/616.3 X
3,656,602 4/1972 Konkel et al. ..... 400/616
4,340,315 7/1982 Teichmann et al. ..... 400/645 X

FOREIGN PATENT DOCUMENTS 63283 4/1982 Japan ..... 400/616.3
19568 1/1985 Japan ..... 400/616.3

*Primary Examiner*—Charles Pearson
*Attorney, Agent, or Firm*—Jones, Tullar & Cooper

[57] ABSTRACT

A document feed device provided with a pin tractor assembly which includes a pin tractor member supporting a number of feed pins and rotated by a feed shaft, and a body member nonrotatably mounted on the tractor member. Elastically deformable projecting bar with a slit protrudes from the body member. A stationary frame member is formed with a slot extending in the axial direction of the feed shaft. An eyelet portion is formed at each end of the slot. The projecting bar elastically engages the slot, thereby preventing the body member from rotating. As the rotating bar slides within the slot, the pin tractor assembly can move along the feed shaft so that its position is adjusted according to the width of a perforated sheet of material. The assembly may be located in either of two positions, depending on the width of the sheet, as the projecting bar alternatively engages the eyelet portions of the slot. The position of the assembly is shifted by manually operating a knob formed on the body member.

7 Claims, 8 Drawing Sheets

26
26a
37
A
X
41
42
40
35
46a
46
51
52
51a
48a
48
49
54
47
59
60
61
60
61
53
50
49
52
45
46
C
X
39
56
55
57
58b
58
58a
B
38
38

49
49a
49b
49c

DOCUMENT FEED DEVICE WITH PIN TRACTOR ASSEMBLY

This is a divisional of co-pending application Ser. No. 814,126 filed on Dec. 27, 1985, now U.S. Pat. No. 4,729,682.

BACKGROUND OF THE INVENTION

The present invention relates to a document feed device adapted to be used in a typewriter, printer, electronic data processing equipment, etc., and provided with a pin tractor assembly which intermittently or continuously transports a document formed of a sheet-like material, e.g., printing paper, and having longitudinally spaced perforations on either side, past a printing position or work station.

In document feed devices of this type, a pin tractor member bears thereon a number of feed pins which engage perforations of a flexible sheet of material. The sheet of material is fed forward or backward in its longitudinal direction as the pin tractor member rotates.

These devices are disclosed in, for example, U.S. Pat. Nos. 2,825,559, 4,022,365 and 4,162,032.

The pin tractor member, in conjunction with a body member nonrotational relative thereto, constitutes the pin tractor assembly. Conventionally, the body member is provided with cam means which engages the feed pins so that the pins are moved radially in the tractor member as the tractor member rotates.

To cope with variations in width of the document to be transported, the prior art document feed devices are constructed so that the pin tractor assembly can be moved for location along the axial direction of a feed shaft. As stated in U.S. Pat. No. 2,825,559 mentioned above, the arrangement for the location includes an auxiliary shaft disposed parallel to the feed shaft, and a clamping mechanism for releasably clamping the pin tractor assembly on the auxiliary shaft at any portion thereof.

In changing the sheet size, the operator first manually releases the clamping mechanism, and slides the pin tractor assembly on the feed shaft until the feed pins engage the perforations of the sheet. In this position, the operator works the clamping mechanism again to lock the body member both axially and in its rotating direction, thereby adjusting the position of the pin tractor assembly.

According to the arrangement described above, therefore, the components used in the device are increased in number, and the construction is complicated. Also, the positioning of the pin tractor assembly is so troublesome that the operation of the device lacks in speed and accuracy.

In the device with the auxiliary shaft, in particular, the auxiliary shaft is disposed in a feed path for the sheet of material. Therefore, the device requires additional means for preventing the auxiliary shaft from interfering with the sheet. The adjustment position of the pin tractor assembly varies with the operator, possibly lowering the accuracy of the sheet feed.

As in U.S. Pat. No. 2,825,559 mentioned before, moreover, the document feed device generally is provided with a sheet holding mechanism in the vicinity of the pin tractor assembly. This mechanism touches the sheet of material from above during the sheet feeding operation with the perforations of the sheet engaging the feed pins, lest the sheet be lifted or dislocated from the position for the engagement with the feed pins. Thus, the mechanism serves to regulate the sheet for stable feed. Also, the holding mechanism is adapted to be located in a closed position where it is in contact with the sheet of material during the feeding operation, and to be moved to an open position where it is separated from the sheet in removing the sheet from the feed pins.

However, the use of the extra sheet holding mechanism would result in a complicated construction of the device, higher manufacturing cost, and inefficient assembling work.

Requiring the operator's manipulation, moreover, the conventional sheet holding mechanism may possibly cause a wrong feeding operation attributed to an omission.

In fabricating the pin tractor assembly, furthermore, the feed pins generally are mounted in radially arranged feed pin bores or grooves. Since the feed pins are small-sized components independent of one another, however, the mounting the mounting work is very troublesome and inefficient.

SUMMARY OF THE INVENTION

The object of the present invention is to provide a document feed device simple in construction, improved in operating efficiency, low in manufacturing cost, and permitting efficient assembling.

According to the present invention, projection means and engagement guide means adapted to elastically engage the same are provided between a body member of a pin tractor assembly and stationary means, e.g., a frame member, of a document feed device. When the two mating means engage each other, the body member is prevented from rotating around an axis, but is allowed to move together with a pin tractor member along the axis. Further provided is locating means for releasably locking the projection means to a predetermined position relative to the engagement guide means with respect to the axis, whereby feed pins can be axially located according to the width of a sheet of material to be fed.

According to a preferred arrangement of the document feed device of the invention, the projection means is a slitted projecting bar provided on the body member, the engagement guide means is a slot formed in the stationary means, and the locating means is formed of eyelet portions formed at both ends of the slot.

As the projecting bar elastically engages the slot, it is allowed to move only in the longitudinal direction of the slot. The bar is releasably held in place when it engages one of the eyelet portions Accordingly, the body member is prevented from rotating, and can alternatively shift its axial position by moving in its axial direction. Thus, the device of the invention is simplified in construction, reduced in cost, and improved in assembling efficiency, without using an auxiliary axis or clamping mechanism as is required by the prior art document feed devices According to the invention, moreover, cover means such as a top cover is provided with rib means. When the cover means is mounted on the frame member, the rib means faces the pin tractor member of the pin tractor assembly, defining therebetween a narrow path through which the sheet of material is transported.

Thus, in the present invention, a stable, accurate feeding operation can be secured without using any special sheet holding mechanism of a complicated construction. Further, the rib means can automatically reach a sheet holding position as the cover means is mounted on the frame member. Therefore, the operator is not expected to perform any separate operation for such positioning, and is free from errors in the feeding operation attributed to an omission.

According to the invention, furthermore, the feed pins are connected to one another by flexible connecting means when they are arranged radially in the pin tractor assembly. The connecting means is designed so as to allow the feed pins to move freely and independently in feed pin bores or grooves of the pin tractor member, in the radial direction of the tractor member.

In assembly, therefore, the feed pins previously connected by the flexible connecting means can be attached as one unit to the pin tractor member. Thus, the efficiency of assembling work is greatly improved.

According to a further preferred embodiment of the invention, the flexible coupling means is formed of a flexible string member, and the feed pins and the string member are integrally formed from plastic material.

Thus, the feed pin unit can be fabricated easily and at low cost.

BRIEF DESCRIPTION OF THE DRAWINGS

These and other objects of the present invention will become more apparent and will be better understood with reference to the following detailed description taken in conjunction with the accompanying drawings, in which.

DETAILED DESCRIPTION OF THE PREFERRED EMBODIMENTS

First, second and third embodiments of the present invention will now be described in detail with reference to the accompanying drawings of FIGS. 1 to 11, FIG. 12, and FIGS. 13 and 14, respectively. Document feed devices according to these embodiments are adapted for use with a printer of a dot-matrix type.

Figure 1:
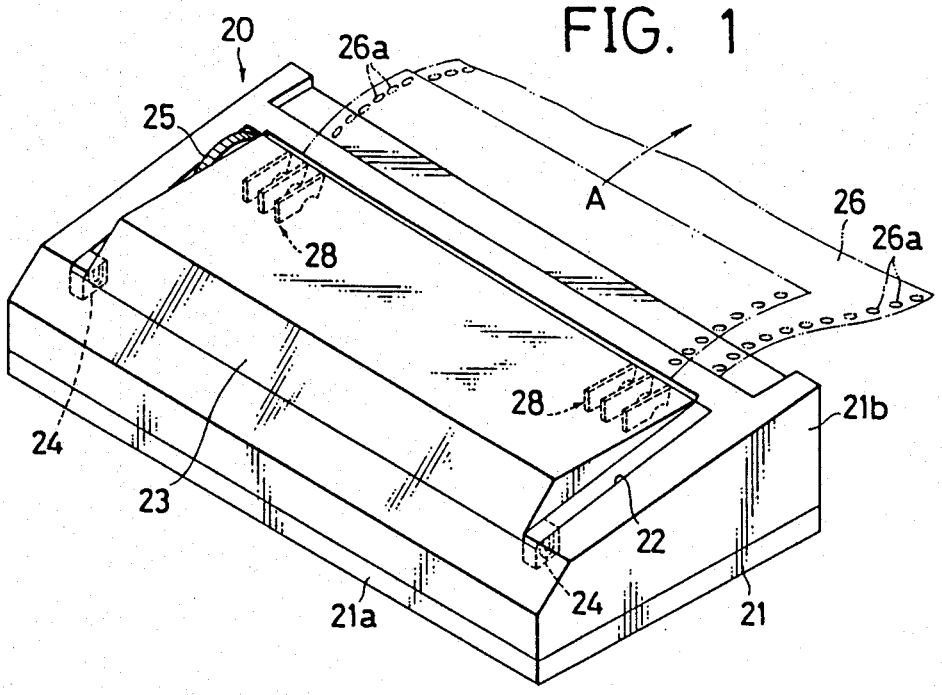
FIG. 1 is a perspective view showing an outline of a printer with a document feed device according to the present invention.

In FIG. 1, a printer 20 has a box-shaped body frame 21. A top cover 23 as cover means is placed on the top of the frame 21 so as to close a rectangular opening 22 which is formed in the top face of the frame 21. The top cover 23 is supported by a pair of hinge portions 24, 24 at a front side **21*a* of the frame 21. Thus, one end portion 23*a* of the cover 23 near a rear side 21*b* of the frame 21 can swing up and down around the hinge portions 24. A printing mechanism of the printer and a document feed device of the invention are located under the one end portion 23*a*. In FIG. 1, a platen knob 25** is exposed.

A printing paper 26 as a sheet of material is inserted into the printer through the rear side **21*b* of the frame 21, s shown in FIG. 1. Then, the printing mechanism performs a predetermined printing operation, and the document feed device intermittently or continuously feeds the printing paper 26 in a forward feed direction indicated by arrow A past a printing position. Longitudinally spaced perforations 26*a* are bored through both side portions of the printing paper 26**.

Figure 2:
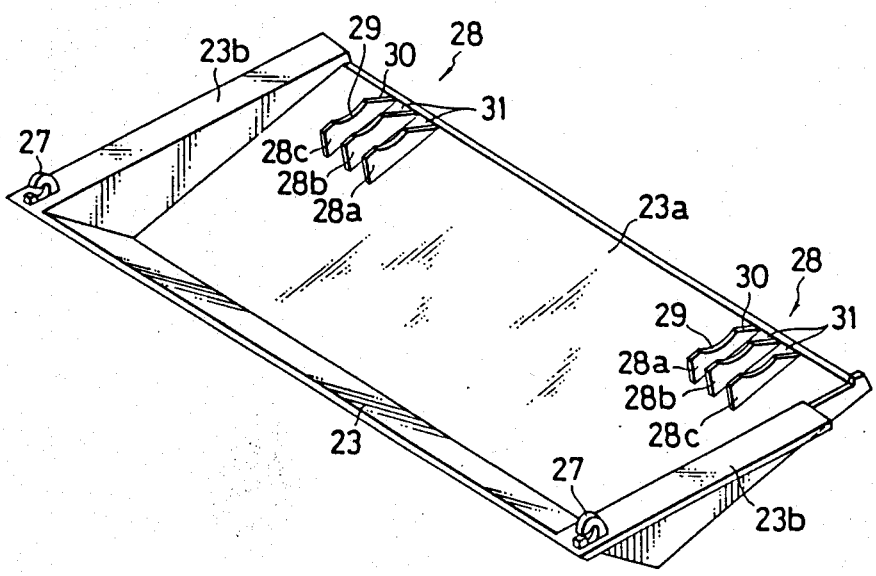
FIG. 2 is an enlarged perspective view showing the reverse side of a top cover of the printer of FIG. 1 formed with rib members.

As shown in FIG. 2, the top cover 23 is provided with a pair of hook portions 27, 27 which removably engage their corresponding hinge portions 24 of the frame 21. A pair of flange portions **23*b*, 23*b* on either side of the cover 23 constitute contact surfaces which are brought closely into contact with the peripheral edge of the opening 22 of the frame 21 when the cover 23 is in a closed position (FIG. 1) on the opening 22. In other words, the flange portions 23*b* serve to determine the closed position of the cover 23**.

Standing upright on the inside surface of the one end portion **23*a* of the cover 23, platelike rib members 28*a*, 28*b* and 28*c* constituting rib means 28 are arranged at predetermined intervals on each side of the one end portion 23*a*. These rib members are each formed with an arcuate surface 29 and a slanting surface 30 continuous therewith. Each rib member is positioned so as to extend along the paper feed direction A when the cover 23 is placed on the frame 21, as shown in FIG. 1. Therefore, each of spaces 31** between the rib members also extends in the direction A.

The top cover 23, including the hook portions 27 and the rib means 28, can be integrally formed from plastic material.

The function of the rib means 28 will later be described with reference to FIGS. 9 to 11.

Figure 3:
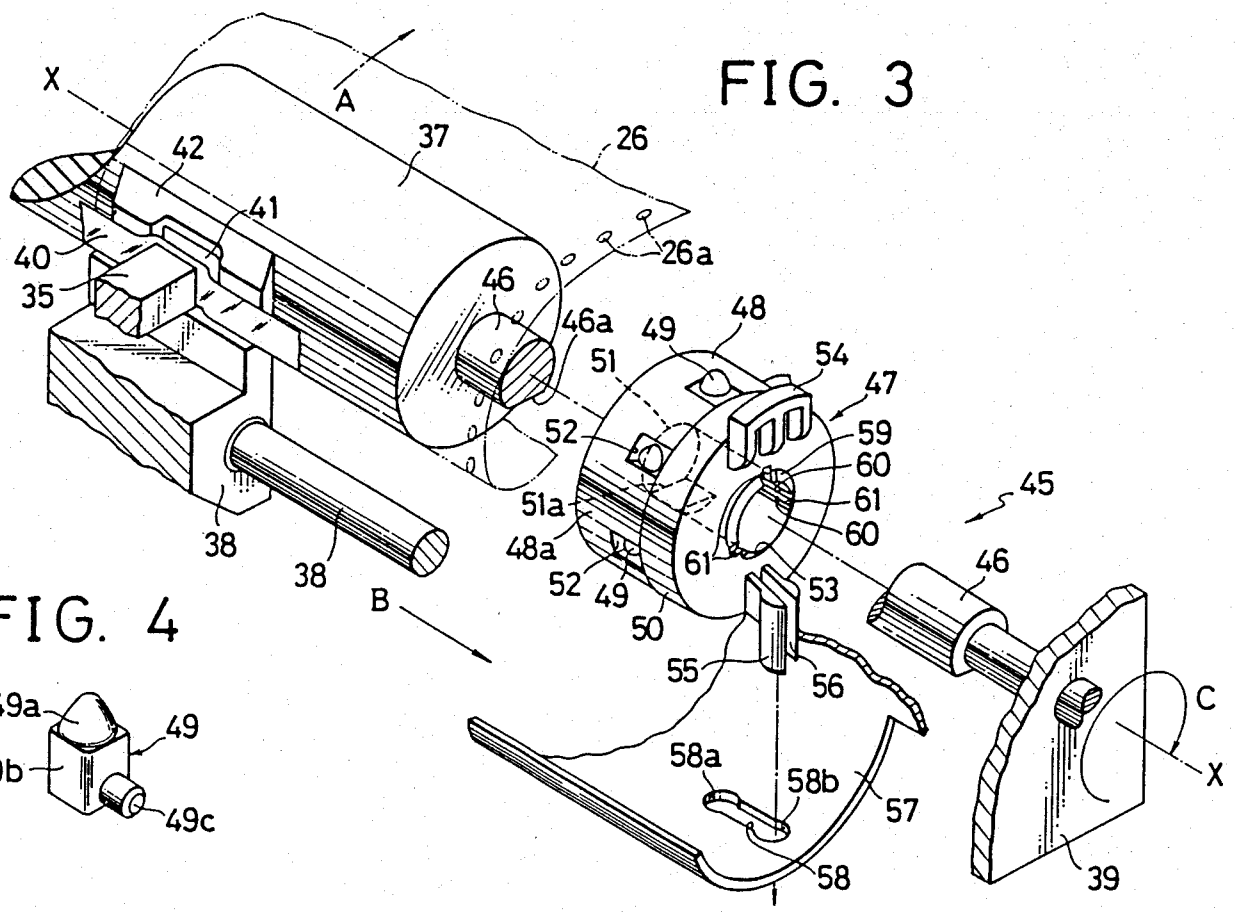
FIG. 3 is an exploded perspective view showing the principal parts of a first embodiment of the document feed device of the invention.

In FIG. 3, a print head 35 of a dot-matrix type of printing mechanism is supported on a carriage 36, which is slidably mounted on a guide shaft 38 extending parallel to a platen 37. The guide shaft 38, along with a body frame 21 (FIG. 1), is supported on a side frame 39 which constitutes part of a frame member or stationary means. In the printing position, the print head 35 performs printing on the printing paper 26 wound on the platen 37, through the medium of a printing ribbon 40. The print head 35 faces the paper 26 through a printing window 41, which is formed in a guide member 42, i.e., a so-called paper meter, integral with the carriage 36. While effecting printing, the print head 35, along with the carriage 36, moves in the forward direction indicated by arrow B along a line of printing of the platen 37, and then returns to accomplish a print for one line on the paper 26. After this is done, platen 37 is rotated by the document feed device 45 so that the paper 26 is fed for one line in the forward feed direction A.

The top cover 23 hangs over the print head 35 and the platen 37 to cover them when the cover 23 is in the closed position.

The platen 37 is adapted to rotate in one with a feed shaft 46 which extends along an axis X—X and i rotatably supported by a pair of side frames 39 (only one shown). The shaft 46 is rotated in a feed direction C or in the opposite direction by a drive motor (not shown).

A pin tractor assembly 47, which constitutes the principal part of the document feed device 45, comprises a pin tractor member 48, a number of feed pins 49 supported in the member 48, and a body member 50.

The pin tractor member 48 has a cylindrical surface 48*a* with the same diameter as the platen 37. Also, the member 48 is formed with a shaft hole 51 through which the feed shaft 46 is passed so that the member 48 can slide along the axis X—X of the shaft 46. The hole 51 has an engaging surface 51*a* which engages a cut surface 46*a* formed on the shaft 46. As the two surfaces 46*a* and 51*a* engage each other, the member 48 is prevented from rotating relatively to the shaft 46, and is allowed only to move axially.

The pin tractor member 48 is formed with grooves 52 which individually receive the feed pins 49 in the radial direction of the member 48, arranged at intervals around the axis X—X. The grooves 52 open to the surface 48*a* of the member 48. Each feed pin 49 is supported so as to be movable in the radial direction of the member 48 in each corresponding groove 52. Thus, a tip portion 49*a* of each pin 49 can project or retract from the surface 48*a*. The pin tractor member 48 is integrally formed from plastic material.

The body member 50 has the same diameter as the pin tractor member 48, and is formed with a shaft hole 53. The member 50 adjoins an opposite face of the member 48 to close those openings of the grooves 52 on the opposite face side. Thus, each groove 52 is shaped like a bore, and the feed pins 49 are prevented from slipping out sideways from their corresponding grooves 52.

The body member 50 is provided integrally with a control knob 54 and a projecting bar 55 as projection means. The member 50 is also integrally formed from plastic material. The knob 54 is adapted to be operated by an operator in moving the body member 50, together with the pin tractor member 48, along the axis X—X. For ease of handling, the knob 54 projects a little from the outer peripheral surface of the body member 50.

The projecting bar 55, which extends radially from the body member 50, has a slit 56 in the center. The bar 55 is capable of elastic deformation such that the width of the slit 56 is changed. Except for the slit 56, the bar 55 has a cylindrical outer peripheral surface.

An arcuate paper guide member 57, which constitutes part of the stationary means or frame member, is located under the platen 37 in close vicinity thereto so as to define a narrow path between the platen 37 and the guide member 57 through which the printing paper 26 is passed. Thus, the member 57 serves to guide the printing paper 26 on the platen 37 toward the printing position.

A slot 58 as engagement guide means is bored through that portion of the paper guide member 57 which corresponds to the projecting lever 55. The slot 58 is elongated along the axis X—X. Eyelet portions 58*a* and 58*b* as locating means, having a diameter a little greater than the width of the slot 58, are formed at both ends of the slot 58. The projecting bar 55 elastically engages the slot 58, thereby preventing the body member 50 from rotating around the axis X—X. Since the bar 55 can move from one of the eyelet portions 58*a* and 58*b* to the other, sliding along the slot 58, the body member 50 may move along the axis X—X within the extent of the slot 58.

By engaging the projecting bar 55 alternatively with the eyelet portions 58*a* and 58*b*, as mentioned later, the position of the feed pins 49 of the pin tractor assembly 47 is adjusted to the width of the paper 26 to be fed.

A sleeve 59 formed on the pin tractor member 48 is fitted in the shaft hole 53 of the body member 50. A plurality of click members 61 are formed by cutting axial slits 60 in the sleeve 59. The click members 61 are urged to spread radially outward, thereby engaging the peripheral edge portion of the hole 53 of the body member 50. Thus, the members 48 and 50 can move as a body along the axis X—X, while the member 48 alone is allowed to rotate relatively around the axis X—X, leaving the member 50 nonrotating.

In fabricating the pin tractor assembly 47 of a unit configuration, the feed pins 49 are first fitted individually into the grooves 52 of the pin tractor member 48, and then the sleeve 59 is inserted into the shaft hole 53 of the body member 50. Thereupon, the click members 61 engage the peripheral edge portion of the hole 53 by snap action, thereby fixedly coupling the members 48 and 50.

In assembling the printer, the projecting bar 55 is fitted in the slot 58 of the paper guide member 57.

Although only the document feed device 45 on one end side of the platen 37 is shown in FIG. 3, a similar device is provided on the other end side.

Figure 4:
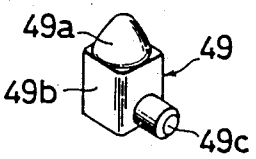
FIG. 4 is an enlarged perspective view showing a feed pin of a pin tractor assembly shown in FIG. 3.

As shown in FIG. 4, each feed pin 49 includes a rectangular body portion 49*b*, the tip portion 49*a* formed integrally on the top of the body portion 49*b*, and a columnar cam follower portion 49*c* formed integrally on one lateral face of the body portion 49*b* perpendicular to its top face. Since the body portion 49*b* corresponds in shape to the groove 52 of the pin tractor member 48, the tip portion 49*a* can be moved only in the radial direction of the member 48 without shakiness when the body portion 49*b* is fitted in the groove 52.

Figure 5:
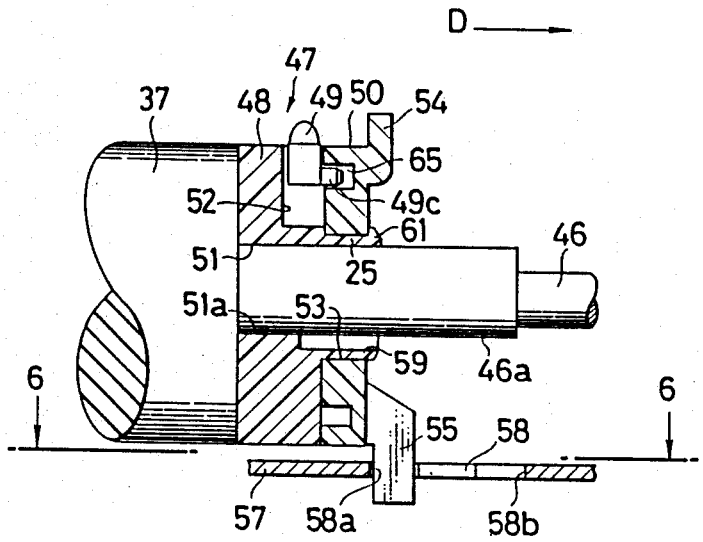
FIG. 5 is a longitudinal sectional view of the pin tractor assembly.

As shown in FIG. 5, the body member 50 is formed with a cam groove 65 constituting cam means. The respective cam follower portions 49*e* of the feed pins 49 engage the cam groove 65. As the pin tractor member 48 rotates, therefore, the portions 49*e* of the feed pins 49 are guided along the cam groove 65, so that the pins 49 move in the radial direction of the member 48 in accordance with the shape of the groove 65. While the printing paper 26 is being fed upward in the forward direction A beyond the printing position, the feed pins 49 project outward to engage the perforations 26*a* of the paper 26. On the front side of the platen 37 facing the print head 35, however, the pins 49 are retracted so as not to interfere with the paper meter or the like.

The arrangement of such cam means for shifting the position of the feed pins is disclosed in U.S. Pat. Nos. 4,022,365 and 4,162,032.

Figure 6:
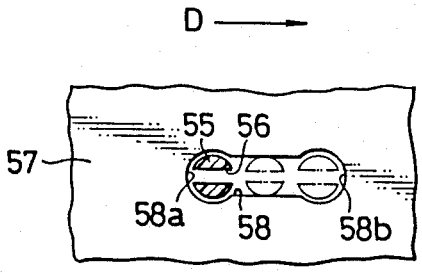
FIG. 6 is a partial plan view taken along line 6—6 of FIG. 5, illustrating the engagement between a projecting bar and a slot.

In FIG. 5, the projecting bar 55 is in engagement L with the one eyelet portion 58*a* of the slot 58. In this position, the pin tractor assembly 47 is in contact with the platen 37. If the knob 54 is pulled to move the assembly 47 in the direction of arrow D, the projecting bar 55 is elastically deformed within the slot 58, as shown in FIG. 6, to engage the other eyelet portion 58*b*. As a result, the pin tractor assembly 47 is kept apart from the platen 37.

Thus, the pin tractor assembly 47 can be located alternatively in two positions. These adjustment positions may be increased in number by providing the slot 58 with an additional eyelet portion or portions. Depending on the tightness of the engagement between the projecting bar 55 and the slot 58, the eyed slot 58 may be replaced with a plain slot without any eyelet portions. In this case, the projecting bar 55 is held at either end of the slot by its resiliency.

Figure 7:
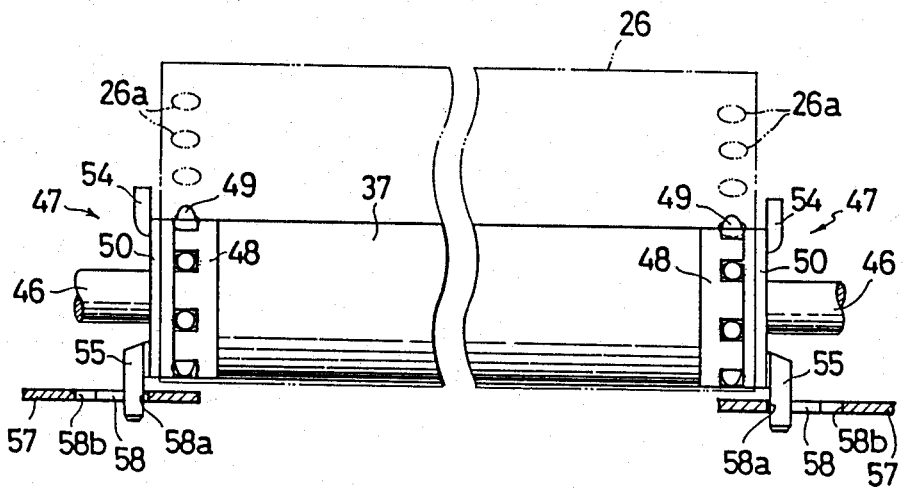
FIGS. 7 and 8 are schematic views showing the way the position of the pin tractor assembly is adjusted according to the width of the sheet of material used.
Figure 8:
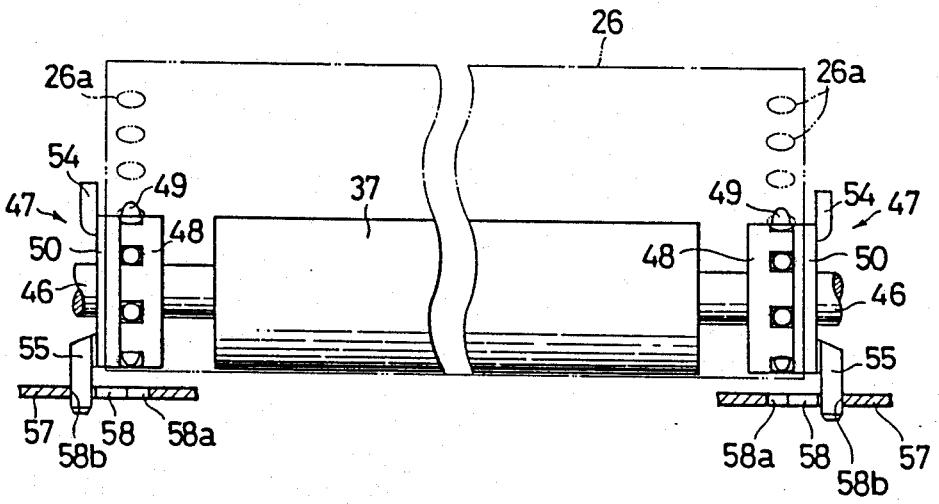

FIGS. 7 and 8 show the way the position of the pin tractor assembly 47 is adjusted according to the width of the printing paper 26.

In FIG. 7, the printing paper 26 has a relatively narrow width, and the pin tractor assemblies 47 on either side of the platen 37 are manually set in positions such that they are in contact with the platen 37, or that the projecting bars 55 engage the eyelet portions 58*a* of their corresponding slots 58. Thus, the axial positions of the pin tractor assemblies 47 are adjusted so that the feed pins 49 can engage the perforations 26*a* of the printing paper 26 on their corresponding sides.

The printing paper 26 shown in FIG. 8 is wider than the one shown in FIG. 7. In FIG. 8, the pin tractor assemblies 47 are manually set in positions such that they are separated from the platen 37, or that the projecting bars 55 engage the other eyelet portions 58*b* of their corresponding slots 58. Thus, as in the aforesaid case, the feed pins 49 are aligned individually with the perforations 26*a* of the paper 26.

The paired pin tractor assemblies 47, in either of the aforesaid positions, are arranged bisymmetrically with respect to the center of the platen 37, so that the printing paper 26 is set so that its center is in alignment with that of the platen 37. To this end, the paper meter or other suitable scale is disposed along the platen 37.

Figure 9:
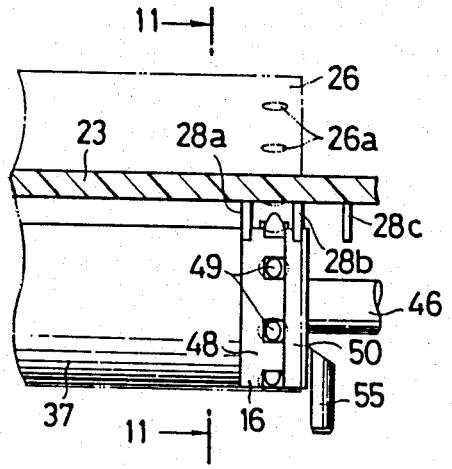
FIGS. 9 and 10 are schematic views for illustrating the positional relationships between the pin tractor assembly and the rib means.
Figure 10:
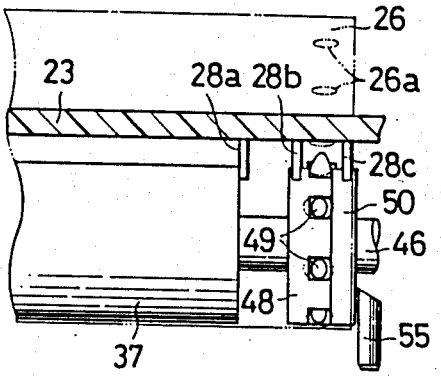
Figure 11:
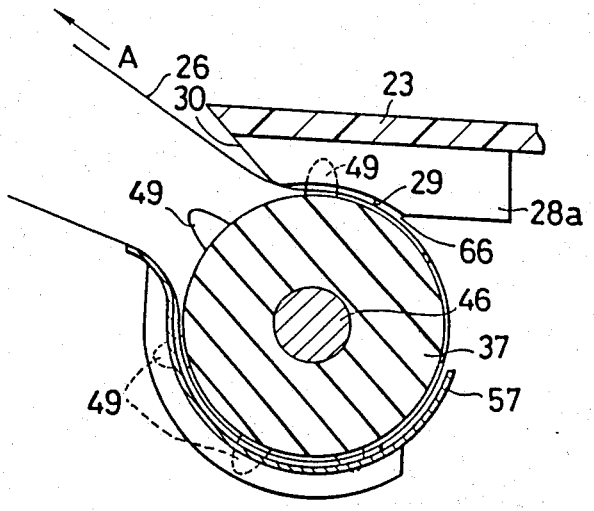
FIG. 11 is an enlarged sectional view taken along line 11—11 of FIG. 9.

Referring now to FIGS. 9, 10 and 11, the function of the rib means 28 will be described in detail.

In these drawings, the top cover 23 is set in place. FIGS. 9 and 10 correspond to FIGS. 7 and 8, respectively, with respect to the width of the paper 26 and the position of the pin tractor assembly 47.

Regardless of the position of the pin tractor assembly 47, the feed pins 49 of the assembly 47 are located in the spaces 31 defined between rib members 28*a* to 28*c*. Therefore, the pins 49 never interfere with the rib members 28*a* to 28*c*. In FIG. 9, the feed pins 49 are located between the rib members 28*a* and 28*b* so that the members 28*a* and 28*b* touch the printing paper 26 from above, thereby preventing the paper 26 from lifting. In FIG. 10, the rib members 28*b* and 28*c* behave in the same manner as the combination of the members 28*a* and 28*b* in FIG. 9.

As seen from FIG. 11, when the cover member 23 is in the closed position, the arcuate surface 29 of the rib member 28*a* extends along the peripheral surface 48*a* of the pin tractor member 48, defining a narrow path 66 between the two surfaces. Thus, the arcuate surface 29 has the same center and substantially the same radius of curvature as the peripheral surface 48*a*. The printing paper 26 is guided through the narrow path 66. In this manner, the perforations 26*a* of the paper 26 are prevented from being disengaged from their corresponding feed pins 49.

The paper 26 fed past the narrow path 66 in the forward direction A is led away from the platen 37 and the pin tractor assembly 47 by the slanting surface 30 continuous with the arcuate surface 29. Thus, the slanting surface 30 is upwardly slanted in the forward direction A.

When the top cover 23 is removed upward from the closed position, the rib member 28*a* is disengaged from the printing paper 26. Thus, the paper 26 can be set and removed freely. During the printing operation of the printer, the top cover 23 is in the closed position, so that the rib means 28 never fail to hold down the paper 26 as needed without requiring the operator's attention.

Although only the rib member 28*a* has been described in connection with FIG. 11, the other rib members 28*b* and 28*c* have the same construction and function as the member 28*a*.

Moreover, the rib means 28 may be provided on any other suitable member than the top cover 23 which is swingable relative to the body frame 21.

Figure 12:
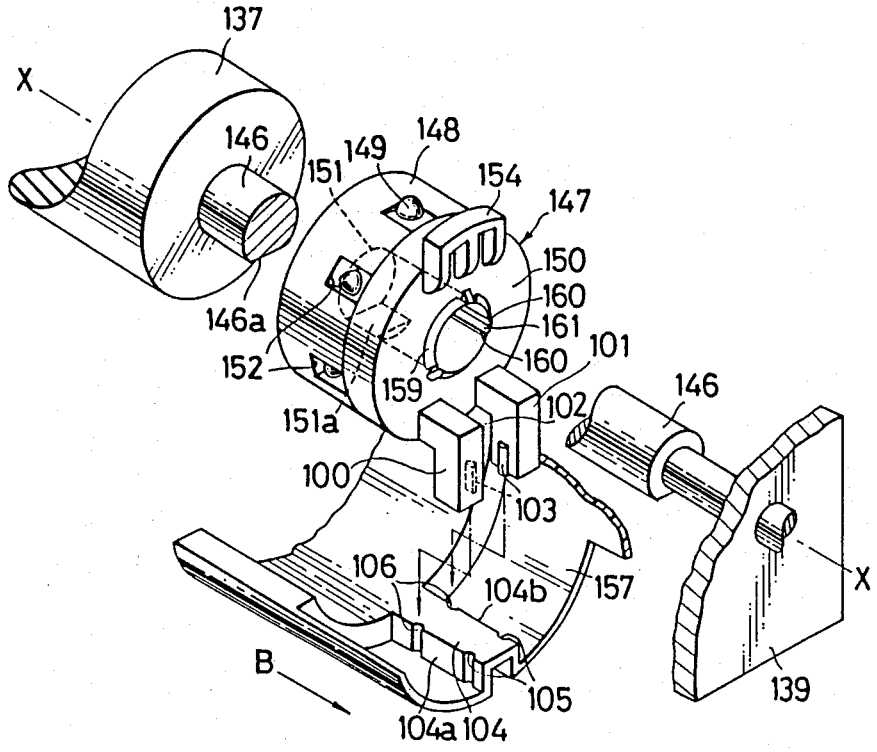
FIG. 12 is an exploded perspective view, similar to FIG. 3, showing a second embodiment of the document feed device of the invention.

The second embodiment of the present invention shown in FIG. 12 resembles the first embodiment shown in FIG. 3 in the constructions and functions of many of its components. In the description to follow, therefore, like portions of the second embodiment as used in the first embodiment are designated by reference numerals obtained by adding 100 to the values of the numerals for their counterparts in the first embodiment. A detailed description of those corresponding portions is omitted herein.

The difference between the first and second embodiments lies in the arrangement of projection means and engagement guide means.

A pair of projecting bars 100 and 101 as projection means are formed integrally on a body member 150 of a pin tractor assembly 147 which is mounted on a feed shaft 146 so as to adjoin a platen 137. The paired projecting bars 100 and 101 extend parallel to each other along the axis X—X, defining an engaging space portion 102 between them. The body member 150 is formed from plastic material, and the projecting bars 100 and 101 are elastically deformable in a direction to vary the width of the space portion 102. The bars 100 and 101 have a rectangular cross section and are bent vertically. An engaging projection 103 is formed integrally on each of opposite surfaces of the bars 100 and 101.

A guide rail 104 as engagement guide means is formed integrally on a paper guide member 157 as a frame member or stationary means. The rail 104 has a pair of vertical engaging surfaces 104*a* and 104*b* which extend parallel to each other along the axis X—X. The engaging surfaces 104*a* and 104*b* are each formed with a pair of vertical engaging recesses 105 and 106 which are spaced in the longitudinal direction of the rail 104. The paper guide member 157 is formed from plastic material.

In assembling the printer, the paired projecting bars 100 and 101 are caused to engage the engaging surfaces 104*a* and 104*b* of the guide rail 104, respectively. In this engagement, the bars 100 and 101 are pressed against their corresponding engaging surfaces 104*a* and 104*b* so as to softly nip the guide rail 104, undergoing an elastic deformation. Guided by the rail 104, the projecting bars 100 and 101, along with the pin tractor assembly 147, can slide along the axis X. Integral with the body member 150, however, the bars 100 and 101 are prevented from rotating around the axis X—X. The slide of the bars 100 and 101 is releasably arrested at two positions where the paired engaging projections 103 alternatively engage the two pairs of engaging recesses 105 and 106. Arranged along the X—X axis, these two positions are adjustment positions for the pin tractor assembly 147 to cope with the variation of the paper width, corresponding to the eyelet portions 58*a* and 58*b* of the slot 58 of the first embodiment. The adjustment positions may be increased by providing the rail 104 with an additional pair or pairs of engaging recesses.

As in the case of the first embodiment, the position of the assembly 147 is adjusted by means of a knob 154 which is formed integrally on the body member 150.

In contrast with the arrangement of the second embodiment, the projecting bars 100 and 101 may be formed on the paper guide member 157, and the guide rail 104 on the body member 150.

Figure 13:
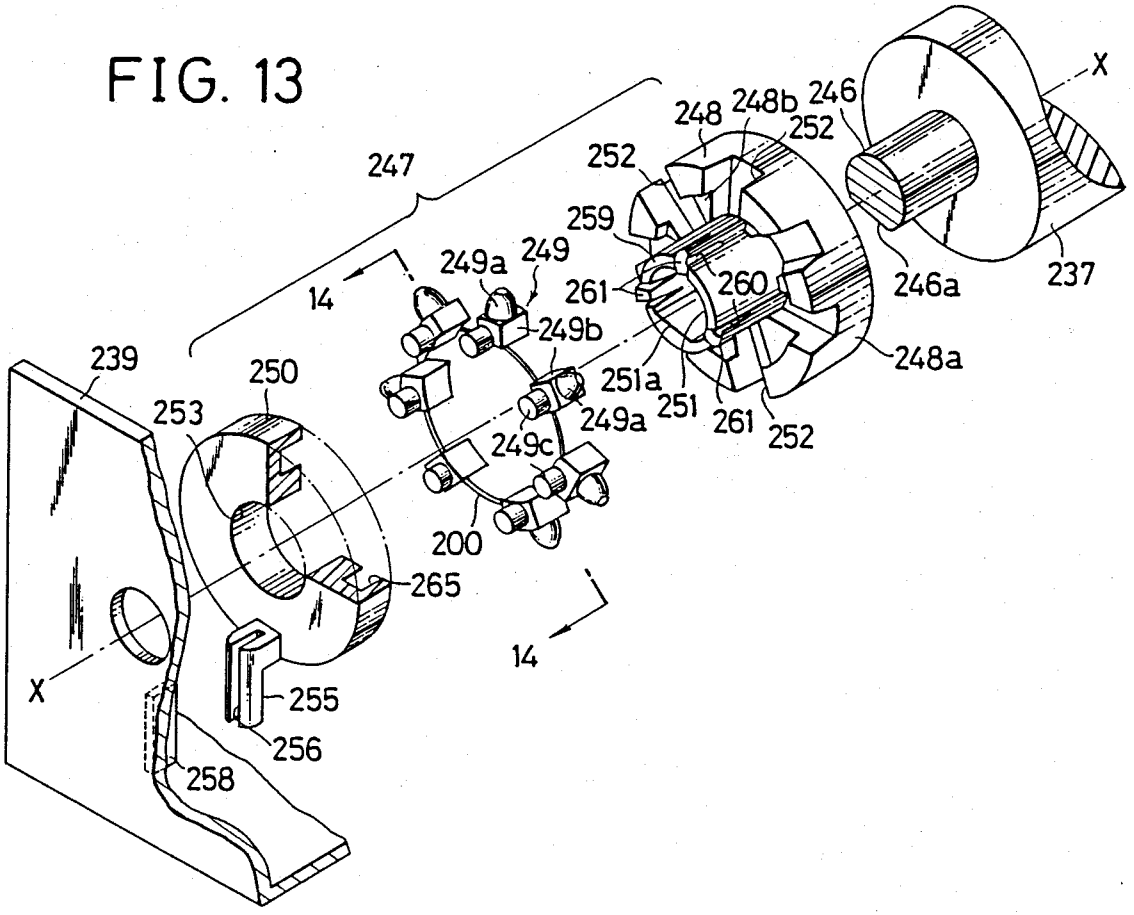
FIG. 13 is an exploded perspective view showing a third embodiment of the document feed device of the invention.

FIG. 13 shows the third embodiment present invention. In the description to follow, like portions of the third embodiment as used in the first embodiment shown in FIGS. 3 to 6 are designated by reference numerals obtained by adding 200 to the values of the numerals for their counterparts in the first embodiment.

A feed shaft 246 for rotating a plate 237 is rotatably supported by a pair of side frame members 239 (only one shown). A pin tractor assembly 247, which is shown in a disassembled form in FIG. 13, is mounted on the feed shaft 246. The assembly 247 includes a pin tractor member 248, a number of feed pins 249, and a body member 250.

The pin tractor member 248 has a shaft hole 251 through which the feed shaft 246 is passed. The hole 251 is formed with an engaging surface 251*a*. When the surface 251*a* engages a cut surface 246*a* of the feed shaft 246, the pin tractor member 248 is prevented from rotating relatively to the shaft 246 around the axis X—X.

Rectangular grooves 252 for supporting the feed pins 249 are formed in the pin tractor member 248, arranged radially around the axis X—X. A sleeve 259 protrudes from the tractor member 248 along the axis X—X. The sleeve 259 is formed with a plurality of click members 261 each having slits 260 on both sides thereof and extending axially. An annular recess 248*b* is formed in that side face of the tractor member 248 which has the grooves 252 therein, surrounding the sleeve 259. The member 248 is integrally formed from plastic material.

The body member 250 has a cam groove 265, as cam means, in that side face thereof which is opposed to the pin tractor member 248. A projecting bar 255 as projection means, having a slit 256 therein, protrudes integrally from the other side face of the member 250.

Facing the projecting bar 255, an engagement guide piece 258 protrudes from the inner surface of the side frame member 239. In assembly, the slit 256 of the projecting bar 255 elastically engages the guide piece 258. Thus, the body member 250 is prevented from rotating around the axis X—X.

Each of the feed pins 249 is integrally formed of a rectangular body portion 249*b*, a tip portion 249*a* on one face of the body portion 249*b*, and a cam follower portion 249*c* on another face of the portion 249*b* perpendicular to the first face. The respective body portions 249*b* of the feed pins 249 are connected with one another by a flexible string member 200 constituting flexible connecting means. When connected, the feed pins 249 are arranged at regular intervals in a circle.

Integrally formed from plastic material, the feed pins 249 and the flexible string member 200 can be mounted as one unit on the pin tractor member 248 and the body member 250.

In assembly, the feed pin unit is mounted on the pin tractor member 248 so that the feed pins 249 are fitted individually in the grooves 252, and the flexible string member 200 in the annular recess 248*b*. Thereafter, the sleeve 259 is inserted into the shaft hole 253 of the body member 250 so that the click members 261 engage the peripheral edge of the shaft hole 253. In this manner, the pin tractor assembly 247 is completed as a rigidly constructed, integral unit. The assembly 247 is fitted on the feed shaft 246 so that the projecting bar 255 engages the engagement guide piece 258. Thus, the assembling of the document feed device is accomplished.

The document feed device of the third embodiment is not provided with any special arrangement for adjusting the position of the assembly 247 along the axis X—X according to the paper size.

It is to be understood, however, that the third embodiment may enjoy a modification such that the device has the same locating means of the first or second embodiment.

Figure 14:
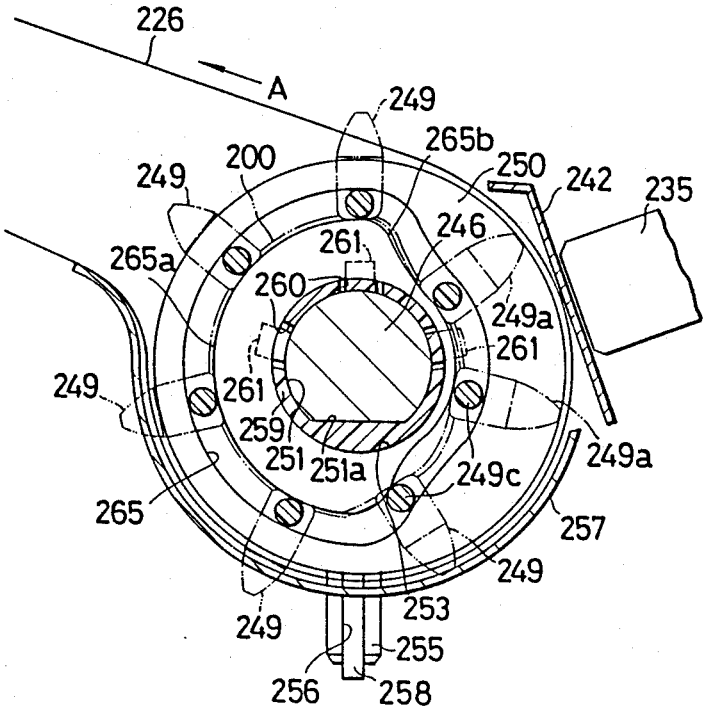
FIG. 14 is a sectional view, taken along line 14—14 of FIG. 13, for illustrating the operation of the device of FIG. 13.

As shown in FIG. 14, the cam groove 265 of the body member 250 includes a cam portion 265*a* concentric with the feed shaft 246 and a cam portion 265*b* smaller in diameter than the portion 265*a*. As the pin tractor member 248 is rotated by the feed shaft 246, the feed pins 249, having their cam follower portions 249*c* fitted in the cam groove 265, are guided by the two cam portions 265*a* and 265*b*. When located at the cam portion 265*a*, the feed pins 249 protrude uniformly from an outer peripheral surface 248*a* of the pin tractor member 248, engaging perforations of a printing paper 226 to positively feed the paper 226 in the forward feeding direction A. When the feed pins 249 are located at the cam portion 265*b*, on the other hand, their tip portions 249*a* are retracted inward from the surface 248*a*. Thus, the feed pins 249 can avoid from interfering with a paper meter 242 which is located in close vicinity to a print head 235.

Guided by the cam groove 265, the feed pins 249 are allowed to move freely in the radial direction of the pin tractor member 248 by the resiliency of the flexible string member 200 connecting the pins 249. Far from hindering the action of the feed pins 249, the flexible string member 200 serves to restrain the pins 249 from acting blindly, thereby preventing chattering and reducing noise.

Although illustrative embodiments of the present invention have been described in detail herein, the document feed device of the invention may suitably be applied to any other printing machines, such as electric typewriters and data processing equipment, besides the printer mentioned herein.

The spirit and scope of the invention should not be limited to any obvious changes or modifications which would occur to those skilled in the art. The invention should be interpreted with respect to the following appended claims.

What is claimed is:

1. A document feed device for a printing apparatus having a platen, said document feed device feeding a sheet of material with longitudinally spaced perforations, comprising:

a frame member having a top opening;

cover means mounted on the frame member so as to be upwardly removable from a closed position where the cover means closes the top opening of the frame member;

a feed shaft rotatably mounted on the frame member and supporting the platen;

a pair of pin tractor assemblies individually slidable along the feed shaft within adjustment ranges predetermined on both sides of the platen, each of the pair of pin tractor assemblies including a pin tractor member having a cylindrical surface and rotatable around an axis of rotation of the feed shaft, and a number of feed pins radially distributed around the axis of rotation so as to individually engage the perforations of the sheet of material; and two groups of rib means fixedly attached to the cover means so as to be individually placed within the adjustment ranges when the cover means is in the closed position, each of the groups of rib means including at least three rib members located side by side at such intervals that the feed pins of each of the pin tractor assemblies can be located between the adjacent rib members when the cover means is in the closed position, said rib members acting as a means to retain the sheet on said tractor members, at least one of the three rib members having an arcuate guide surface which faces the cylindrical surface of the tractor member when the cover means is in the closed position, said guide surface of the rib member and said cylindrical surface of the tractor member defining therebetween a narrow path through which the sheet of material is passed when the cover means is in the closed position, thereby preventing the feed pins from being disengaged from the perforations of the sheet of material.

2. The document feed device according to claim 1, wherein said pin tractor assembly can move along the axis of rotation of the feed shaft to be located alternatively in at least two different positions, said positions corresponding individually to spaces defined between the adjacent rib members, whereby the feed pins of the pin tractor assembly can be located in any of the spaces.

3. The document feed device according to claim 1, wherein said cover means includes a top cover swingably hinged, at one end edge portion thereof, on the frame member, and said groups of rib means are provided on the reverse side of the top cover at the other end edge portion thereof.

4. The document feed device according to claim 3, wherein said rib member protrudes substantially perpendicularly from the undersurface of the top cover and extends across said axis of rotation of said feed shaft.

5. The document feed device according to claim 1, wherein said pin tractor member has substantially the same diameter as that of said platen, said cover means hangs over said platen and a print head movable along said platen to cover the same.

6. The document feed device according to claim 1, wherein each of said pair of pin tractor assemblies includes a control knob manually operable for adjusting the position of said pin tractor member in axial direction of said feed shaft.

7. A document feed device for a printing apparatus having a platen, said document feed device feeding a sheet of material with longitudinally spaced perforations, comprising:

a frame member having a top opening;

cover means mounted on the frame member so as to be upwardly removable form a close position where the cover means closes the top opening of the frame member;

a feed shaft rotatably mounted on the frame member and supporting the platen;

a pair of pin tractor assemblies individually slidable along the feed shaft within adjustment ranges predetermined on both sides of the platen, each of the pair of pin tractor assemblies including a pin tractor member having substantially the same diameter as that of the platen and rotatable around an axis of rotation of the feed shaft, and a number of feed pins radially distributed around the axis of rotation so as to individually engage the perforations of the sheet of material; and two groups of rib means secured to the cover means so as to be individually placed within the adjustment ranges when the cover means is in the closed position, said rib members acting as a means to retain the sheet on said tractor members, each of the groups of rib means including at least three rib members located side by side at such intervals that the feed pins of each of the pin tractor assemblies can be located between the adjacent rib members when the cover means is in the closed position, whereby the feed pins of the pin tractor assembly can be located selectively in at least two different positions corresponding to spaces defined between the adjacent rib members.

* * * * *